US010626711B1

(12) United States Patent
Trautman et al.

(10) Patent No.: US 10,626,711 B1
(45) Date of Patent: Apr. 21, 2020

(54) METHOD OF PRODUCING HYDROCARBON RESOURCES USING AN UPPER RF HEATING WELL AND A LOWER PRODUCER/INJECTION WELL AND ASSOCIATED APPARATUS

(71) Applicant: EAGLE TECHNOLOGY, LLC, Melbourne, FL (US)

(72) Inventors: Mark A. Trautman, Melbourne, FL (US); Brian N. Wright, Indialantic, FL (US)

(73) Assignee: EAGLE TECHNOLOGY, LLC, Melbourne, FL (US)

( * ) Notice: Subject to any disclaimer, the term of this patent is extended or adjusted under 35 U.S.C. 154(b) by 0 days.

(21) Appl. No.: 16/177,695

(22) Filed: Nov. 1, 2018

(51) Int. Cl.
*E21B 43/24* (2006.01)
*E21B 47/06* (2012.01)

(52) U.S. Cl.
CPC ..... *E21B 43/2401* (2013.01); *E21B 47/06* (2013.01); *E21B 47/065* (2013.01)

(58) Field of Classification Search
CPC ..... E21B 43/2401; E21B 47/06; E21B 47/065
See application file for complete search history.

(56) References Cited

U.S. PATENT DOCUMENTS 7,441,597 B2 10/2008 Kasevich
7,891,421 B2 2/2011 Kasevich
8,616,273 B2 12/2013 Trautman et al.
9,044,731 B2 6/2015 Blue et al.
9,057,237 B2 6/2015 Blue et al.
9,103,205 B2 8/2015 Wright et al.
9,200,506 B2 12/2015 Blue et al.
9,739,126 B2 8/2017 Trautman et al.
2009/0188661 A1* 7/2009 Bizon ..... E21B 43/12 166/52
2010/0078163 A1 4/2010 Banerjee et al.
2010/0294488 A1 11/2010 Wheeler et al.
2010/0294489 A1 11/2010 Dreher, Jr. et al.
2011/0309988 A1 12/2011 Parsche
2012/0043081 A1* 2/2012 Kjorholt ..... E21B 43/2406 166/272.1
2012/0085533 A1 4/2012 Madison et al.
2012/0234537 A1* 9/2012 Sultenfuss ..... E21B 43/2408 166/272.3
2014/0014324 A1 1/2014 Wright et al.
2014/0014326 A1 1/2014 Blue et al.

OTHER PUBLICATIONS

Mukhametshina et al. "Electromagnetic Heating of Heavy Oil and Bitumen: A Review of Experimental Studies and Field Applications" Journal of Petroleum Engineering: vol. 2013, Article ID 476519, pp. 7.

* cited by examiner

*Primary Examiner* — Silvana C Runyan
(74) *Attorney, Agent, or Firm* — Allen, Dyer, Doppelt & Gilchrist, P.A.

(57) ABSTRACT

A method of producing hydrocarbon resources from a subterranean formation may include heating the subterranean formation with at least one radio frequency (RF) antenna located in an upper well within the subterranean formation. The method may further include producing hydrocarbon resources from a lower well within the heated subterranean formation and vertically beneath the upper well to create a void within the subterranean formation, and injecting a solvent into the void within the heated subterranean formation from the lower well.

19 Claims, 6 Drawing Sheets

METHOD OF PRODUCING HYDROCARBON RESOURCES USING AN UPPER RF HEATING WELL AND A LOWER PRODUCER/INJECTION WELL AND ASSOCIATED APPARATUS

TECHNICAL FIELD

The present invention relates to the field of hydrocarbon resource recovery, and, more particularly, to hydrocarbon resource recovery methods using radio frequency heating devices.

BACKGROUND

Energy consumption worldwide is generally increasing, and conventional hydrocarbon resources are being consumed. In an attempt to meet demand, the exploitation of unconventional resources may be desired. For example, highly viscous hydrocarbon resources, such as heavy oils, may be trapped in sands where their viscous nature does not permit conventional oil well production. This category of hydrocarbon resource is generally referred to as oil sands. Estimates are that trillions of barrels of oil reserves may be found in such oil sand formations.

In some instances, these oil sand deposits are currently extracted via open-pit mining. Another approach for in situ extraction for deeper deposits is known as Steam-Assisted Gravity Drainage (SAGD). The heavy oil is immobile at reservoir temperatures, and therefore, the oil is typically heated to reduce its viscosity and mobilize the oil flow. In SAGD, pairs of injector and producer wells are formed to be laterally extending in the ground. Each pair of injector/producer wells includes a lower producer well and an upper injector well. The injector/production wells are typically located in the payzone of the subterranean formation between an underburden layer and an overburden layer.

The upper injector well is used to typically inject steam, and the lower producer well collects the heated crude oil or bitumen that flows out of the formation, along with any water from the condensation of injected steam and some connate water in the formation. The injected steam forms a steam chamber that expands vertically and horizontally in the formation. The heat from the steam reduces the viscosity of the heavy crude oil or bitumen, which allows it to flow down into the lower producer well where it is collected and recovered. The steam and gases rise due to their lower density. Gases, such as methane, carbon dioxide, and hydrogen sulfide, for example, may tend to rise in the steam chamber and fill the void space left by the oil defining an insulating layer above the steam. Oil and water flow is by gravity driven drainage urged into the lower producer well.

Many countries in the world have large deposits of oil sands, including the United States, Russia, and various countries in the Middle East. Oil sands may represent as much as two-thirds of the world's total petroleum resource, with at least 1.7 trillion barrels in the Canadian Athabasca Oil Sands, for example. At the present time, only Canada has a large-scale commercial oil sands industry, though a small amount of oil from oil sands is also produced in Venezuela. Because of increasing oil sands production, Canada has become the largest single supplier of oil and products to the United States. Oil sands now are the source of almost half of Canada's oil production, while Venezuelan production has been declining in recent years. Oil is not yet produced from oil sands on a significant level in other countries.

U.S. Published Patent Application No. 2010/0078163 to Banerjee et al. discloses a hydrocarbon recovery process whereby three wells are provided: an uppermost well used to inject water, a middle well used to introduce microwaves into the reservoir, and a lowermost well for production. A microwave generator generates microwaves which are directed into a zone above the middle well through a series of waveguides. The frequency of the microwaves is at a frequency substantially equivalent to the resonant frequency of the water so that the water is heated.

Along these lines, U.S. Published Patent Application No. 2010/0294489 to Dreher, Jr. et al. discloses using microwaves to provide heating. An activator is injected below the surface and is heated by the microwaves, and the activator then heats the heavy oil in the production well. U.S. Published Patent Application No. 2010/0294488 to Wheeler et al. discloses a similar approach.

U.S. Pat. No. 7,441,597 to Kasevich discloses using a radio frequency generator to apply radio frequency (RF) energy to a horizontal portion of an RF well positioned above a horizontal portion of an oil/gas producing well. The viscosity of the oil is reduced as a result of the RF energy, which causes the oil to drain due to gravity. The oil is recovered through the oil/gas producing well.

U.S. Pat. No. 7,891,421, also to Kasevich, discloses a choke assembly coupled to an outer conductor of a coaxial cable in a horizontal portion of a well. The inner conductor of the coaxial cable is coupled to a contact ring. An insulator is between the choke assembly and the contact ring. The coaxial cable is coupled to an RF source to apply RF energy to the horizontal portion of the well.

U.S. Patent Application Publication No. 2011/0309988 to Parsche discloses a continuous dipole antenna. More particularly, Parsche disclose a shielded coaxial feed coupled to an AC source and a producer well pipe via feed lines. A non-conductive magnetic bead is positioned around the well pipe between the connection from the feed lines.

U.S. Patent Application Publication No. 2012/0085533 to Madison et al. discloses combining cyclic steam stimulation with RF heating to recover hydrocarbons from a well. Steam is injected into a well followed by a soaking period wherein heat from the steam transfers to the hydrocarbon resources. After the soaking period, the hydrocarbon resources are collected, and when production levels drop off, the condensed steam is revaporized with RF radiation to thus upgrade the hydrocarbon resources.

Unfortunately, long production times, for example, due to a failed start-up, to extract oil using SAGD may lead to significant heat loss to the adjacent soil, excessive consumption of steam, and a high cost for recovery. Significant water resources are also typically used to recover oil using SAGD, which may impact the environment. Limited water resources may also limit oil recovery. SAGD is also not an available process in permafrost regions, for example, or in areas that may lack sufficient cap rock, are considered "thin" payzones, or payzones that have interstitial layers of shale.

Additionally, production times and efficiency may be limited by post extraction processing of the recovered oil. More particularly, oil recovered may have a chemical composition or have physical traits that may require additional or further post extraction processing as compared to other types of oil recovered.

SUMMARY

A method of producing hydrocarbon resources from a subterranean formation may include heating the subterranean formation with at least one radio frequency (RF) antenna located in an upper well within the subterranean formation. The method may further include producing hydrocarbons from a lower well within the heated subterranean formation and vertically beneath the upper well to create a void within the subterranean formation, and injecting a solvent into the void within the heated subterranean formation from the lower well.

More particularly, heating may include pre-heating the subterranean formation with the at least one RF antenna prior to producing the hydrocarbon resources. By way of example, pre-heating may include pre-heating the subterranean formation to a temperature in a range of 80-100° C. prior to initiating producing.

In accordance with one example implementation, producing and injecting may be cycled over time. Furthermore, in accordance with another example implementation, injecting may comprise injecting the solvent into the void from the lower well while simultaneously producing hydrocarbons from the lower well. Furthermore, heating may comprise continuously heating the subterranean formation with the at least one RF antenna from the upper well during producing and injecting.

By way of example, the upper and lower wells may be parallel to one another. Furthermore, a pressure of the solvent injected into the void may be decreased over time. In addition, the lower well may include a solvent supply pipe and a producer pipe adjacent thereto.

A related apparatus for producing hydrocarbon resources from a subterranean formation may include a radio frequency (RF) source and at least one radio frequency (RF) antenna located in an upper well within the subterranean formation and configured to heat the subterranean formation based upon RF power from the RF source. The apparatus may further include a producer pipe and a solvent supply pipe positioned within a lower well vertically beneath the upper well, a recovery pump coupled to the producer pipe and configured to recover hydrocarbon resources from the subterranean formation from the lower well, and a solvent source coupled to the solvent supply pipe and configured to inject a solvent into the subterranean formation from the lower well.

DETAILED DESCRIPTION

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

By way of background, some RF hydrocarbon recovery systems include an upper solvent injector well, and a producer well below the injector well. Solvents (e.g., propane, light alkanes or other relatively light hydrocarbons) are injected into a deposit to dilute the heavy oil or bitumen. The solvent advantageously reduces the native viscosity of or thins the hydrocarbon resources. Furthermore, an RF antenna is positioned within the injector well to apply RF heating to the formation, which also reduces the viscosity of the heavy oil and allows it to flow more easily into the producer well below for recovery. One such example well configuration is set forth in U.S. Pat. No. 9,739,126 to Trautman et al., which is assigned to the present Assignee and hereby incorporated herein in its entirety by reference. While this configuration is highly effective, the flow cross sectional area required to deliver the solvent through the antenna may, in some instances, increase the well casing to non-conventional, and therefore more expensive, sizes.

Generally speaking, the present approach advantageously allows installation of an RE antenna within smaller conventional casing sizes, as it provides RF heating from an upper antenna well, but moves the solvent injection function to the lower well. That is, the upper (antenna) well provides RF energy to the formation, and there is no solvent injection from the upper well. Rather, solvent injection and hydrocarbon production are both provided through the lower well.

Figure 1:
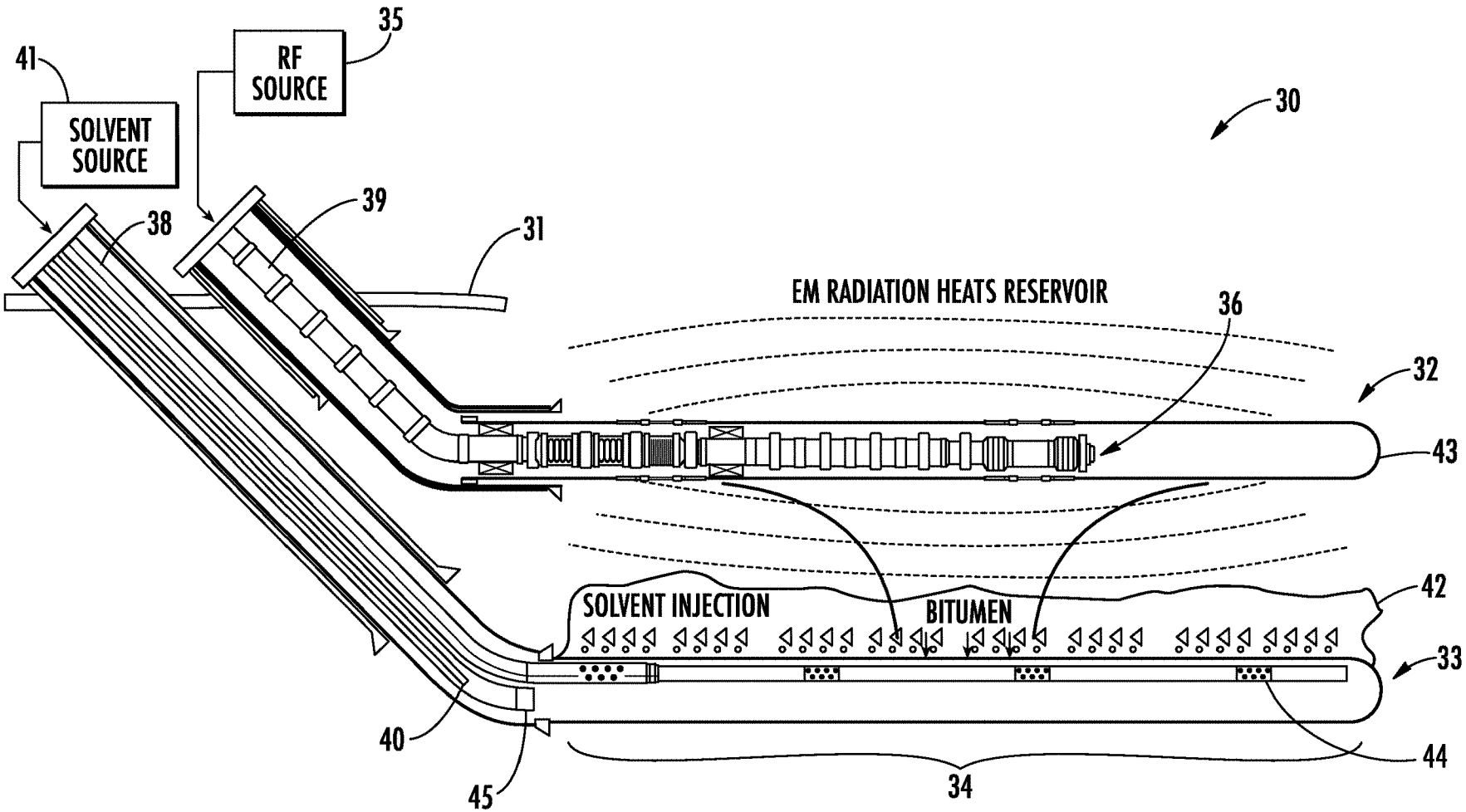
FIG. 1 is a schematic block diagram of an apparatus for hydrocarbon resource recovery including an upper RF heating well and a lower producer/solvent injection well in accordance with an example embodiment.
Figure 2:
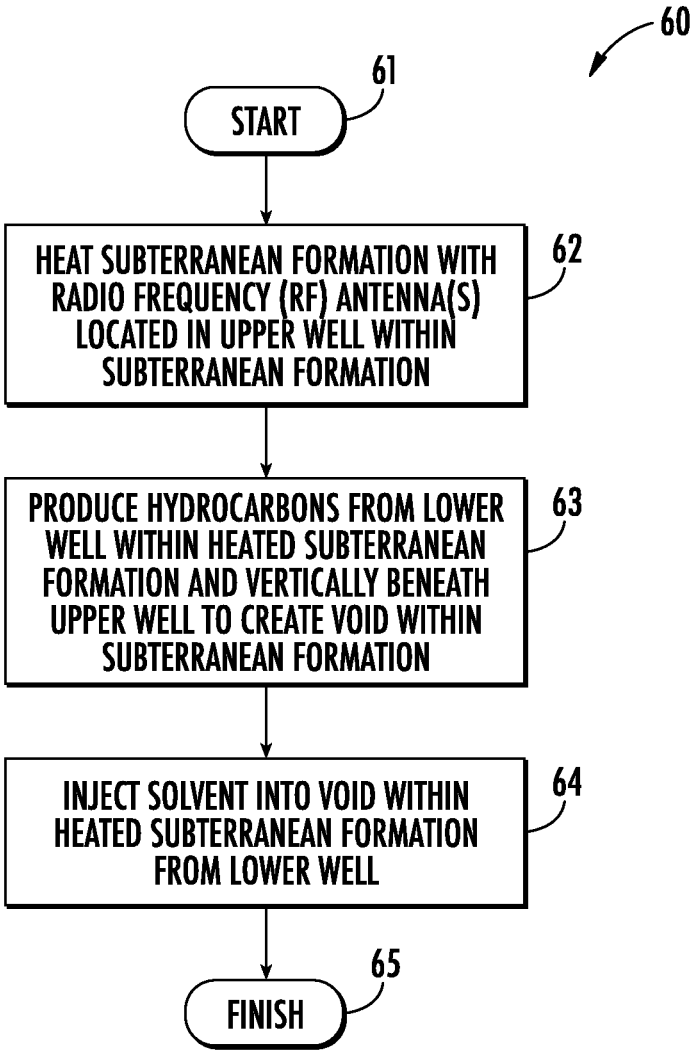
FIG. 2 is a flow diagram illustrating example method aspects associated with the apparatus of FIG. 1.

Referring initially to FIG. 1 and the flowchart 60 of FIG. 2, an apparatus 30 and associated method of recovering hydrocarbon resources in a subterranean formation 31 is now described. The subterranean formation 31 illustratively includes an upper well 32 and a lower well 33 therein, with the lower well being vertically below the upper well. The upper and lower wells 32, 33 illustratively initially extend diagonally from the surface of the subterranean formation to a desired depth, and then laterally within the subterranean formation along a payzone 34 where hydrocarbon (e.g., bitumen or heavy oil) recovery is to occur. The payzone 34 will be located at various depths depending on the location of the subterranean formation 31, and the length of the payzone may also vary between different implementations. By way of example, a relatively thin payzone may be in a range of ten meters or less, while a larger payzone may be between thirty and forty meters, though again other ranges of payzones may be accommodated by the apparatus 30 and recovery techniques discussed herein.

In the illustrated example, the apparatus includes a radio frequency (RF) source 35 at the wellhead, and one or more RF antennas located in the upper well 32 and configured to heat the subterranean formation 31 based upon RF power from the RF source, at Block 62. More particularly, the RF power is supplied from the RF source 35 to an RF transmission line 39 having an RF feed section 36, which is within and coupled to an electrically conductive well pipe 43. The RF transmission line 39 may be a coaxial transmission line, for example. The electrically conductive well pipe 43 may be a wellbore liner, for example, and defines an RE antenna (e.g., a dipole antenna) with the RE feed portion 36. Of course, other antenna configurations may be used in different embodiments.

The electrically conductive well pipe 43 may have a tubular shape, for example, to allow for equipment, sensors, etc. to be passed therethrough. More particularly, a temperature sensor and/or a pressure sensor may be positioned on or within the RF transmission line 39 and/or RF feed section 36. A temperature and/or a pressure sensor may alternatively or additionally be positioned on or within the electrically conductive well pipe 43 to read temperatures and pressures of the subterranean formation 31, as will be discussed further below.

The apparatus 30 further illustratively includes a producer pipe 37 and a solvent supply pipe 38 positioned within the lower well 33. A recovery pump 40 is coupled to the producer pipe 37 and configured to recover hydrocarbon resources from the subterranean formation 31 from the lower well 33, at Block 63. In the illustrated example the recovery pump 40 is a submersible pump positioned within the electrically conductive well pipe of the second well 33, although in some embodiments the recovery pump may be positioned above the subterranean formation 31 at the wellhead. The recovery pump 40 may be an artificial gas lift (AGL), or other type of pump, for example, using hydraulic or pneumatic lifting techniques.

The initial production begins to create a void 42 within the payzone 34 as oil is drawn from the subterranean formation 31, as will be discussed further below. Furthermore, a solvent source 41 is coupled to the solvent supply pipe 38 and configured to inject a solvent into the subterranean formation 31 from the lower well 33, at Block 64, which illustratively concludes the method of FIG. 2 (Block 65). The solvent supply pipe 38 illustratively includes openings 44 spaced along a length thereof within the payzone 34. However, the number of injection points shown is just an example, and different numbers and spacings of the openings 44 may be used in different configurations, depending on the length of the payzone 34, type of solvent being used, etc. In the illustrated configuration, the openings 44 may be spaced apart from an inlet 45 of the producer pipe 37 to help avoid extraction of solvent before it has a chance to enter the formation 31.

Figure 3A:
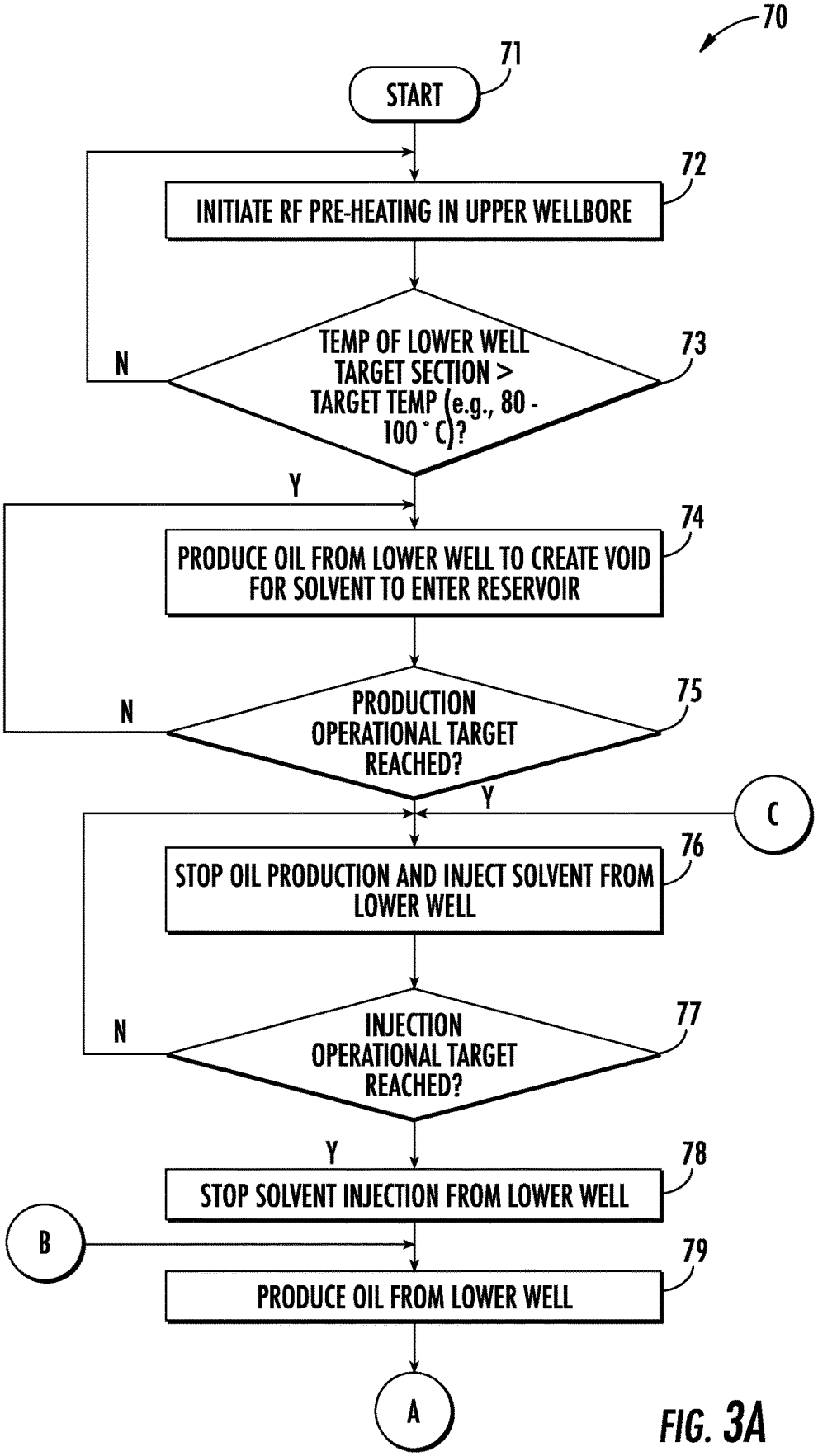
FIGS. 3A and 3B are parts of a flow diagram illustrating an example cyclical production/injection hydrocarbon resource recovery approach for the apparatus of FIG. 1 in accordance with an example embodiment.
Figure 3B:
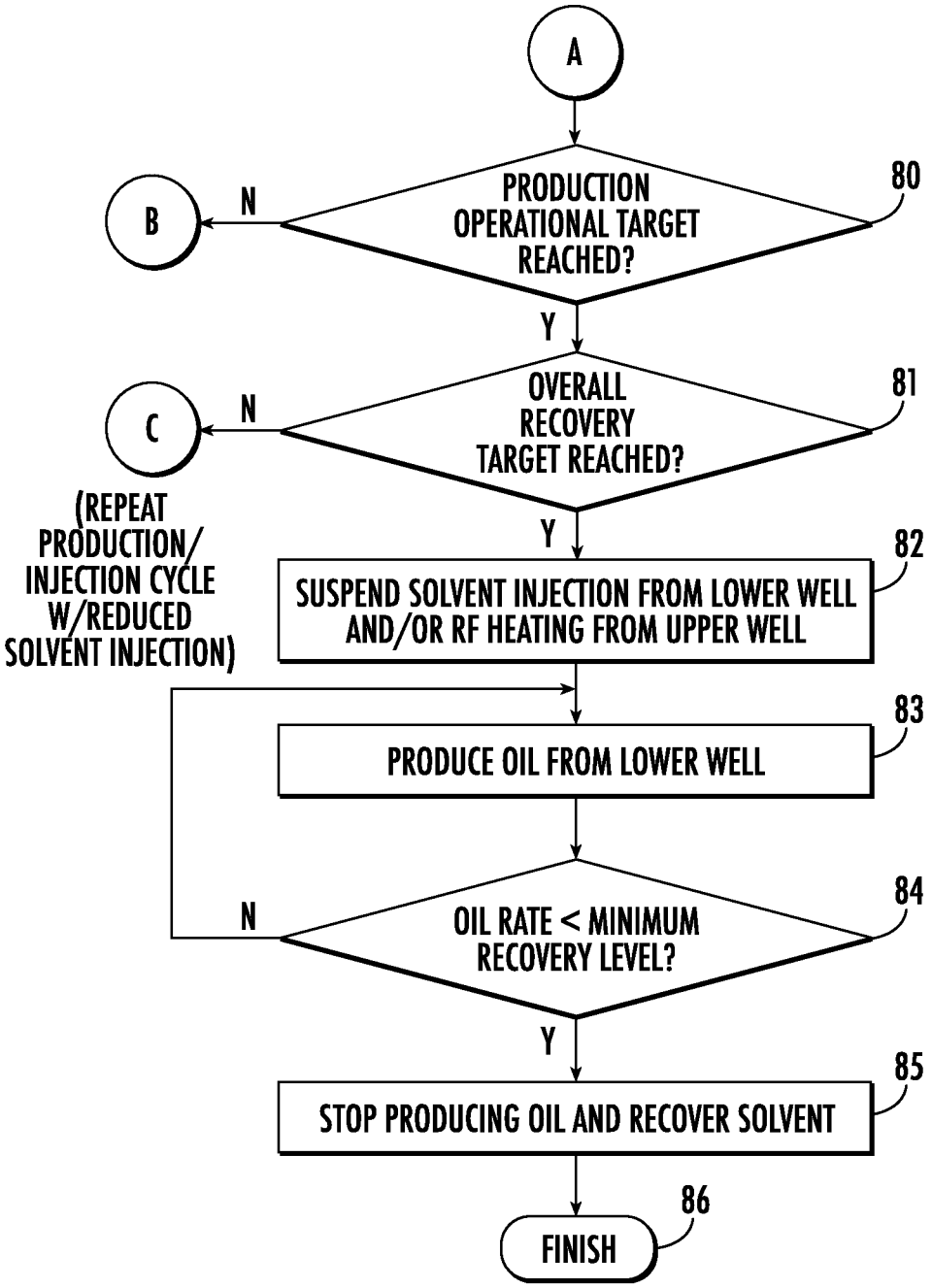

Referring additionally to the flow diagram 70 of FIGS. 3A-3B, an example implementation of the above-described hydrocarbon production method is now described which utilizes a cyclical production/injection approach, alternating between hydrocarbon production and solvent injection from the lower well 33. Beginning at Block 71, RF heating is initiated from the RF source 35 to begin pre-heating the formation 31 to a desired starting temperature, at Blocks 72-73. In one example embodiment, the target production starting temperature may be in a range of 50 to 200° C., and more particularly 80 to 100° C., measured from a temperature sensor(s) within the lower well 33 (and/or upper well 32 in some embodiments). However, other target temperatures may be used in different embodiments as well. The preheating phase may take two to three months in a typical implementation, although slower or faster pre-heating may occur with different geological formations and implementations.

Once the desired temperature is reached, oil may then be produced from the lower well 44 to create the void 42 within the formation 31, through which the solvent will enter the formation, at Block 74. Production may continue until the desired operational target is reached, at Block 75. By way of example, the target may be production for a certain period of time, for a certain initial quantity of oil, while above a target oil rate, etc., to create the desired initial void size within the formation 31. Once production ceases (e.g., the recovery pump 40 is turned off), then solvent injection from the lower well 33 commences (e.g., by turning on the solvent source 41), at Block 76, until an injection operational target is reached, at Block 77. Here again, this may be based upon an amount of time solvent is injected, a quantity of solvent injected, etc. Once the target is reached, then solvent injection may be stopped (e.g., by shutting off the solvent source 41) and oil production resumed (e.g., by turning back on the recovery pump 40), at Blocks 78-79. Here again, production continues until the desired operational target is reached for the current cycle, at Block 80.

Numerous injection/production cycles may then be run (i.e., Blocks 76-79) until an overall recovery target is reached for the formation 31, at Block 81. Different operational considerations may be applicable depending upon the geographical region of operation, the geological formation, etc., as will be appreciated by those skilled in the art. By way of example, 20-100 cycles may be appropriate depending upon the particular geological area where production occurs, although different numbers of cycles may be used in different embodiments. Solvent injection and/or RF heating may be suspended, at Block 82, and a final production phase performed (Block 83) until the oil rate falls below a minimum recovery rate, at Block 84. At this point oil production is discontinued, and the solvent may be recovered from the formation 31, if desired, at Block 85. This concludes the method illustrated in FIGS. 3A-3B, at Block 86.

In some embodiments, it may be advantageous to continuously apply RF heating throughout the cyclical process. The RF heating extends the production period and thereby increases the aggregate oil rate by refluxing a portion of the solvent in the bitumen draining to the lower well 33. As the mixture approaches the producer it is heated from the RF heating, which causes some of the solvent to flash off. The liberated solvent vapor is available to support the vapor chamber pressure, and it migrates to the vapor chamber boundary where it is once again diffused into raw bitumen, diluting it and reducing the viscosity so that it drains to the lower well 33 by gravity. This reflux reduces the amount of makeup solvent required, which permits longer production and shorter injection cycles, respectively. This is unlike traditional processes like cyclic steam (e.g., SAGD) where the injected fluid also supplies the heat and pressure support to the reservoir. Once the steam injection phase is complete the chamber pressure immediately begins to decrease as the steam cools and condenses to liquid, resulting in relatively shorter production cycles. In some embodiments, further pressure control may also be achieved by introducing additional gas (e.g., an inert gas such as nitrogen) into the void 42 along with the solvent in some embodiments.

Figure 4:
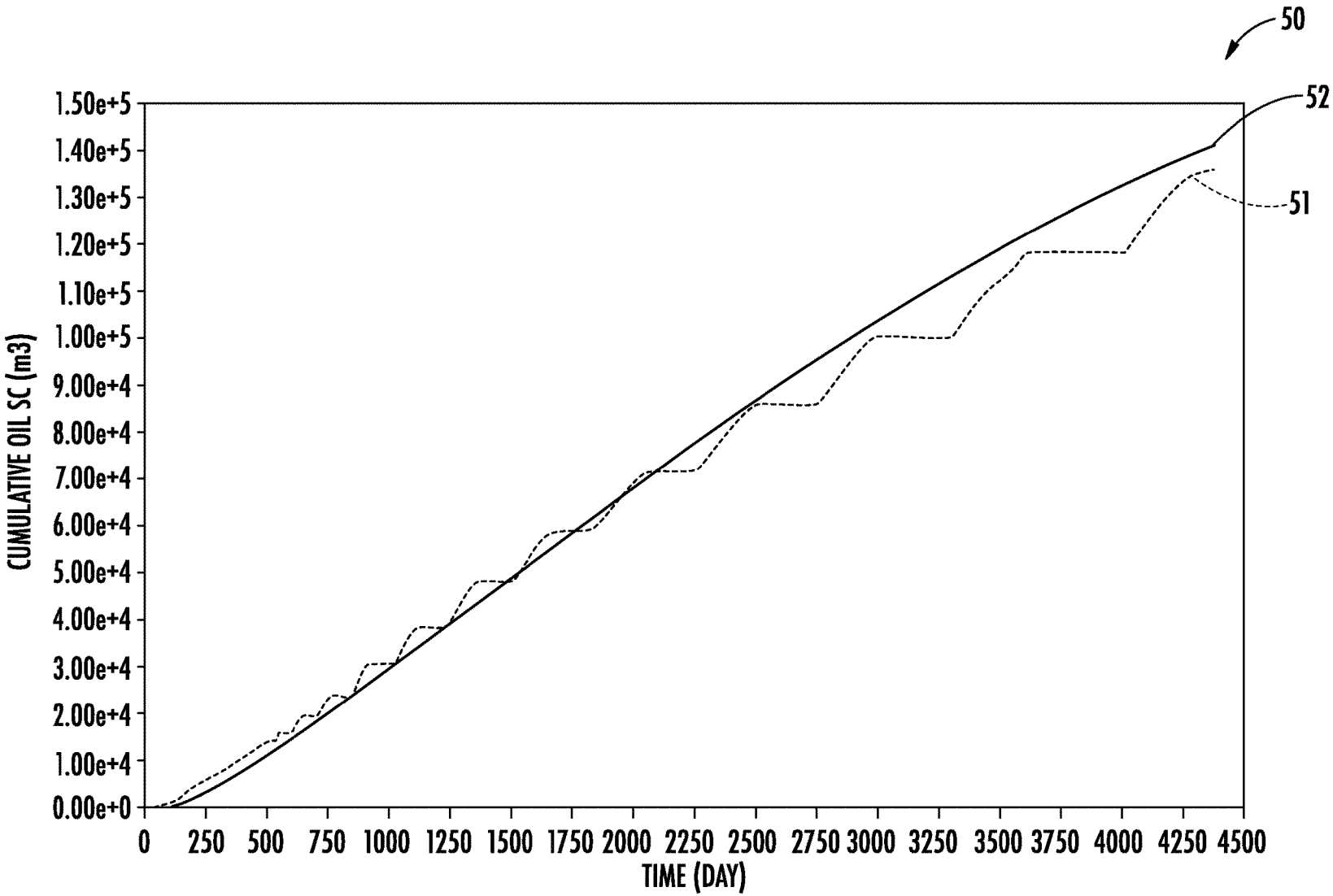
FIG. 4 is a graph of oil produced vs. time comparing the hydrocarbon resource recovery approach of FIGS. 3A and 3B with a prior hydrocarbon resource recovery approach.

Referring additionally to the graph 50 of FIG. 4, a comparison of cumulative oil production over time for a simulated example using the apparatus 30 and the cyclic recovery approach described above is represented by the dashed plot line 51. By way of comparison, a plot line 52 represents simulated oil production using the above-noted approach set forth in U.S. Pat. No. 9,739,126, i.e., where solvent injection occurs from the same upper well where the antenna is located. While the simulated results from the '126 patent approach provide slightly higher output over the same time period, the output from the present approach is comparable, yet the present approach advantageously allows for smaller (i.e., standard) size well casings and a potential for reduced solvent injection, and, accordingly, lower operating costs.

Figure 5:
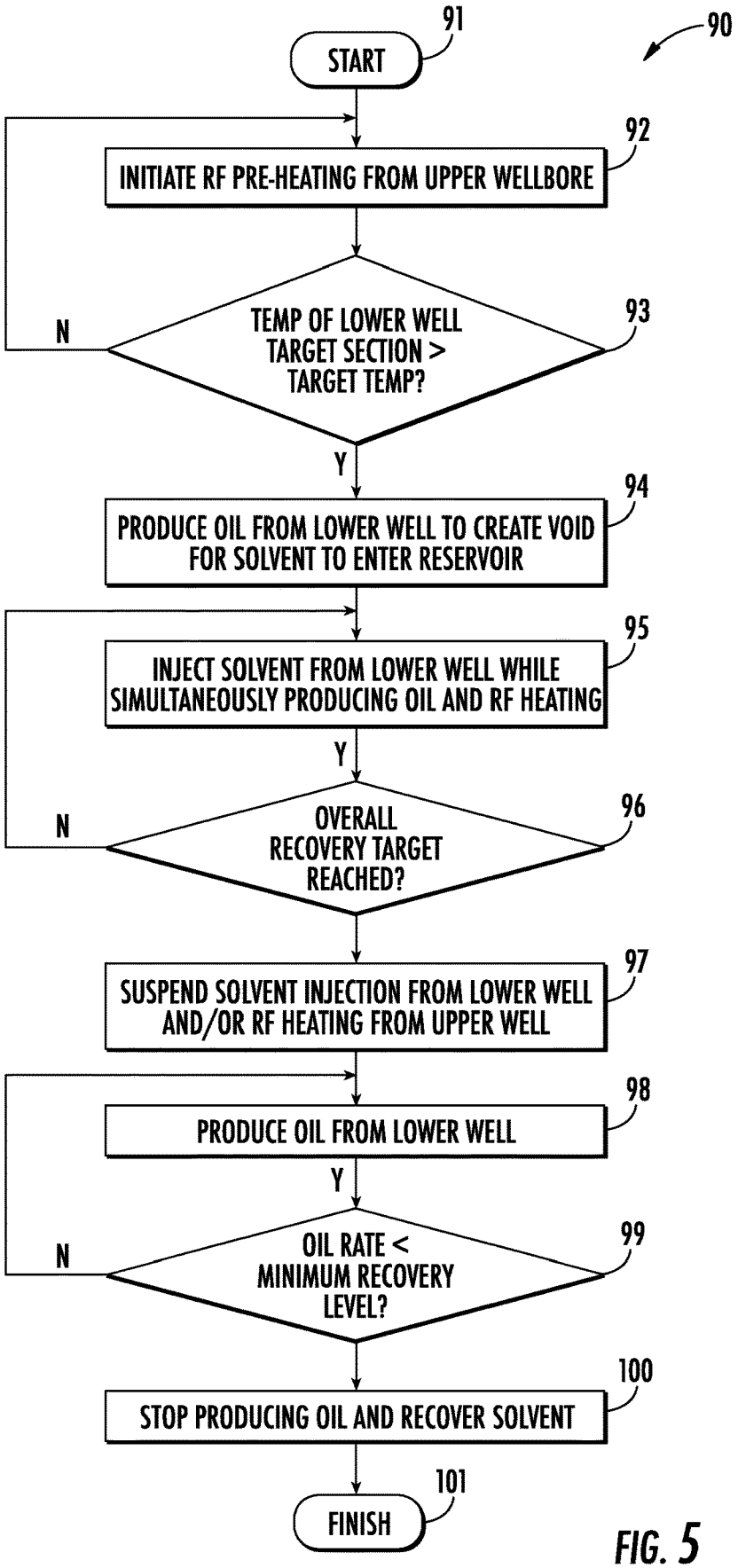
FIG. 5 is a flow diagram illustrating an example continuous production/injection hydrocarbon resource recovery approach for the apparatus of FIG. 1 in accordance with an example embodiment.

Turning now to the flow diagram 90 of FIG. 5, another example operating method for the apparatus 30 is described.

Beginning at Block 91, the method illustratively includes pre-heating the formation 31 from the upper well 32 to a target temperature, and then oil production begins to create the void 42 within the formation, as described above (Blocks 92-94). However, rather than ceasing production at this point as described above, production (and optionally RF heating) continues and solvent injection commences from the lower well, at Block 95. This process may then continue until the overall recovery target for the well is reached, at Block 96. At this point, solvent injection and/or RF heating are suspended (Block 97) while an optional final production occurs until the oil recovery rate falls below a minimum level, at which point production is discontinued and the solvent optionally recovered, at Blocks 98-100, as discussed above. The method of FIG. 5 illustratively concludes at Block 101. It should be noted that in some embodiments, a combination of sequential operation and continuous operation may be performed, if desired.

Further details of recovering or producing hydrocarbon resources may be found in U.S. Pat. Nos. 9,044,731; 9,057,237; 9,200,506; 9,103,205; and U.S. Pub. Nos. 2014/0014324 and 2014/0014326, which are all assigned the Assignee of the present application, and the entire contents of which are herein incorporated by reference. Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

That which is claimed is:

1. A method of producing hydrocarbon resources from a subterranean formation comprising:

heating the subterranean formation with at least one radio frequency (RF) antenna located in an upper well within the subterranean formation;

producing hydrocarbon resources from a lower well within the heated subterranean formation and vertically beneath the upper well to create a void within the subterranean formation;

injecting a solvent upward into the void within the heated subterranean formation from the lower well; and the heating comprising continuously heating the subterranean formation with the at least one RF antenna from the upper well during producing and injecting to create solvent vapor for refluxing the solvent.

2. The method of claim 1 wherein heating comprises pre-heating the subterranean formation with the at least one RF antenna prior to producing the hydrocarbon resources.

3. The method of claim 2 wherein pre-heating comprises pre-heating the subterranean formation to a temperature in a range of 80–100° C. prior to initiating producing.

4. The method of claim 1 wherein producing and injecting are cycled over time.

5. The method of claim 1 wherein injecting comprises injecting the solvent into the void from the lower well while simultaneously producing the hydrocarbon resources from the lower well.

6. The method of claim 1 wherein the upper and lower wells are parallel to one another.

7. The method of claim 1 wherein a pressure of the solvent injected into the void is decreased over time.

8. The method of claim 1 wherein the lower well comprises a solvent supply pipe and a producer pipe adjacent thereto.

9. A method of producing hydrocarbon resources from a subterranean formation comprising:

pre-heating the subterranean formation with at least one radio frequency (RF) antenna located in an upper well within the subterranean formation;

producing hydrocarbon resources from a lower well within the heated subterranean formation and vertically beneath the upper well to create a void within the subterranean formation;

injecting a solvent upward into the void within the heated subterranean formation from the lower well;

cycling producing and injecting over time; and continuously heating the subterranean formation with the at least one RF antenna from the upper well during the producing and injecting cycles to create solvent vapor for refluxing the solvent, the refluxing comprising when a solvent and hydrocarbon resources mixture approaches the lower well, generating solvent vapor from the solvent and hydrocarbon resources mixture, and causing the solvent vapor to migrate to a vapor chamber boundary for additional diffusion into the hydrocarbon resources in the subterranean formation.

10. The method of claim 9 wherein the upper and lower wells are parallel to one another.

11. The method of claim 9 wherein a pressure of the solvent injected into the void is decreased over time.

12. A method of producing hydrocarbon resources from a subterranean formation comprising:

pre-heating the subterranean formation with at least one radio frequency (RF) antenna located in an upper well within the subterranean formation;

producing hydrocarbon resources from a lower well within the heated subterranean formation and vertically beneath the upper well to create a void within the subterranean formation;

injecting a solvent upward into the void within the heated subterranean formation from the lower well while simultaneously producing hydrocarbon resources from the lower well; and continuously heating the subterranean formation with the at least one RF antenna from the upper well during producing and injecting to create solvent vapor for refluxing the solvent.

13. The method of claim 12 wherein the upper and lower wells are parallel to one another.

14. The method of claim 12 wherein a pressure of the solvent injected into the void is decreased over time.

15. An apparatus for producing hydrocarbon resources from a subterranean formation comprising:

a radio frequency (RF) source;

at least one RF antenna located in an upper well within the subterranean formation and configured to continuously heat the subterranean formation based upon RF power from the RF source during producing and injecting to create solvent vapor for refluxing a solvent;

a producer pipe and a solvent supply pipe positioned within a lower well vertically beneath the upper well;

a recovery pump coupled to the producer pipe and configured to recover hydrocarbon resources from the subterranean formation from the lower well to create a void within the heated subterranean formation; and a solvent source coupled to the solvent supply pipe and configured to inject the solvent upward into the void in the subterranean formation from the lower well.

16. The apparatus of claim 15 wherein the recovery pump and the solvent source are configured to respectively recover hydrocarbon resources and inject solvent into the subterranean formation in a cyclical fashion over time.

17. The apparatus of claim 15 wherein the solvent supply pipe and the producer pipe are configured to inject the solvent into the void from the lower well while simultaneously producing hydrocarbon resources from the lower well.

18. The apparatus of claim 15 wherein the upper and lower wells are parallel to one another.

19. The apparatus of claim 15 wherein a pressure of the solvent injected into the subterranean formation decreases over time.

* * * * *